US008157218B2

(12) United States Patent
Riley et al.

(10) Patent No.: US 8,157,218 B2
(45) Date of Patent: Apr. 17, 2012

(54) RAILWAY VEHICLE DETECTION

(75) Inventors: Charles Edward Riley, Wiltshire (GB); Michael Kenneth John Chapman, Wiltshire (GB)

(73) Assignee: Westinghouse Brake and Signal Holdings Limited, Wiltshire (GB)

( * ) Notice: Subject to any disclaimer, the term of this patent is extended or adjusted under 35 U.S.C. 154(b) by 297 days.

(21) Appl. No.: 10/571,487

(22) PCT Filed: Nov. 30, 2004

(86) PCT No.: PCT/GB2004/005036

§ 371 (c)(1),
(2), (4) Date: Mar. 8, 2006

(87) PCT Pub. No.: WO2005/056363

PCT Pub. Date: Jun. 23, 2005

(65) Prior Publication Data

US 2007/0084972 A1 Apr. 19, 2007

Related U.S. Application Data

(60) Provisional application No. 60/542,151, filed on Feb. 5, 2004.

(30) Foreign Application Priority Data

Dec. 5, 2003 (GB) ..... 0328202.7
Apr. 16, 2004 (GB) ..... 0408476.0

(51) Int. Cl.
*B61L 23/34* (2006.01)

(52) U.S. Cl. ..... 246/122 R

(58) Field of Classification Search ..... 246/20, 246/27, 122 R, 123, 167 R; 701/19, 200, 701/207; 342/126
See application file for complete search history.

(56) References Cited

U.S. PATENT DOCUMENTS

| | | | | |
|---|---|---|---|---|
| 3,996,590 | A * | 12/1976 | Hammack | 342/465 |
| 5,437,422 | A * | 8/1995 | Newman | 246/5 |
| 5,893,043 | A * | 4/1999 | Moehlenbrink et al. | 701/207 |
| 6,072,421 | A * | 6/2000 | Fukae et al. | 342/42 |

FOREIGN PATENT DOCUMENTS

| | | |
|---|---|---|
| DE | 26 18 078 | 9/1977 |
| DE | 31 24 884 | 3/1982 |
| DE | 30 43 461 | 7/1982 |
| DE | 197 49 697 | 4/1999 |
| EP | 0 658 774 | 6/1995 |
| FR | 2 547 914 | 12/1984 |

OTHER PUBLICATIONS

International Preliminary Report on Patentability, Jun. 15, 2006.

* cited by examiner

*Primary Examiner* — Joe Morano, IV
*Assistant Examiner* — R. J. McCarry, Jr.
(74) *Attorney, Agent, or Firm* — Husch Blackwell LLP

(57) ABSTRACT

A method is disclosed of detecting a railway vehicle, comprising using the time difference between receiving at first and second points a signal sent from the vehicle at a given time to produce an indication of the location of the vehicle.

26 Claims, 1 Drawing Sheet

RAILWAY VEHICLE DETECTION

Figure 1:
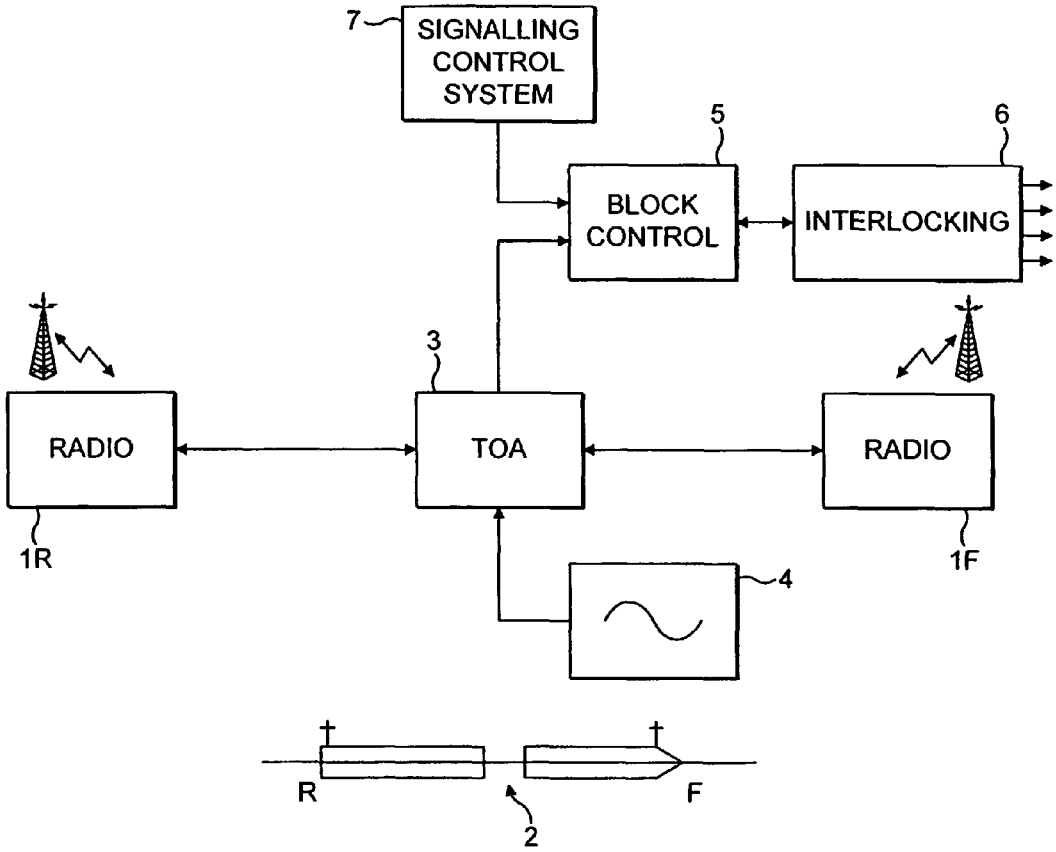

The present invention relates to railway vehicle detection.

Railway signalling solutions require some form of train detection to meet the most basic signalling requirement of "lock and block" which underpins safe train separation. Currently there are two main solutions achieving this function, track circuits and axle counting, with a third, train location reporting by radio, currently in its infancy.

Track circuits and axle counting achieve train detection by breaking the railway into detection areas known as "blocks". The sizes of the detection areas are variable, with exact sizes being constrained by railway capacity and operational requirements. Achieving the detection functionality by using devices such as track circuits and axle counters is intrusive and the whole life costs of such a solution tend to be high, both in terms of solution reliability and its maintainability. Achieving detection through vehicle mounted sensors and then utilising position reporting through radio, is complex, but more importantly, introduces a latency component that ultimately limits capacity on the railway.

According to the present invention from one aspect, there is provided a system for detection of a railway vehicle, comprising means for using the time difference between reception at first and second points of a signal sent from the vehicle at a given time to produce an indication of the location of the vehicle.

According to the present invention from another aspect, there is provided a method of detecting a railway vehicle, comprising using the time difference between receiving at first and second points a signal sent from the vehicle at a given time to produce an indication of the location of the vehicle.

Examples of the present invention use what will be defined as "time differential blocking". This is an approach that moves the train detection function implementation away from being directly track mounted (such as track circuits and axle counters) and away from being train carried (tachometers and the use of Doppler) to being a remote trackside calculation. Using established time differential functions deployed in such systems as RADAR or navigational systems such as LORAN, a communication timing function is deployed in a railway such that time differentials can be correlated to train position.

For simplicity, the basic approach of using time in a RADAR system is explained below. Then the novel use of the principle for railway signalling is explained.

Radar systems use the principle that the speed of radio waves is uniform under most conditions, that is 299,792,458 m/s. A pulse mode radar system transmits a pulse time at "$t_o$", this pulse then proceeds at the uniform propagation speed to the intended reflection target and a reflected pulse is returned at "$t_1$". A high speed counter is started at $t_o$ and stopped at $t_1$. The difference $(t_1-t_o)$ can be directly correlated to distance by using the propagation speed of the pulse.

In a similar manner, a pulse emanating from a single point can be measured at two separate fixed remote points which will receive the pulse at $t_2$ and $t_3$, and as the propagation speed is constant from the single points to the two remote reference points, a navigational locus function can be used to determine where the fixed transmission point is. For the purpose of this application, the correlation function, where the location of the transmitting point is located by using the differences in reception time, is known as the "time differential".

Communication based railway signalling systems, be they European Rail Traffic Management System (ERTMS) based systems using the Global System for Mobile Communication (GSM) network, or bespoke radio signalling systems, have a common feature—namely the ability of a vehicle to transmit a radio signal to trackside infrastructure. Where the communication device is not necessarily part of the signalling system, it may still be present in the form of a voice communication device intended for driver communications or for emergency use. As such communication devices are mobile (i.e. train mounted) they therefore need to transition between trackside sets of radio infrastructure, typically known as "cells". Such cells normally overlap for availability reasons. Communication devices within cells continually announce their presence in a "paging" fashion to facilitate handover between base station cell equipment.

Using the time differential approach, it is possible to utilise a common system clock (such as a clock derived from a Global Positioning by Satellite (GPS) source or landbased source (such as Rugby MSF) which is highly accurate and can be used for synchronisation by fixed receiving points. Radio messages from the mobile train-carried equipment, such as regular paging messages or real traffic messages, can therefore be referenced to a fixed receiving point and by navigational triangulation, the position of the vehicle can be determined at the point of transmission. For railway signalling use, the time differences can be bounded and segmented in accordance with the block lengths required to operate the railway at the appropriate capacity, and the time differences can therefore be used for railway signalling "blocking" purposes.

Time differential blocking then, allows the occupancy of track blocks to be determined and the information used within conventional signalling principles, without the use of track circuits or axle counters, and without the need for a vehicle to transmit its own location to the trackside infrastructure.

For an ERTMS infrastructure, the base stations used in the system can use a common GPS clock signal and messages can be time-stamped at point of receipt. High speed transfer of the time-stamping can then be used by adjacent cells to generate the time differential block information for input to the signalling system as conventional digital inputs, or as a series message. Where conventional cells do not overlap, an eavesdropping receiver can be deployed as a reference point and the time differential block deployed as described. Conventional train detection is no longer required.

For a non-ERTMS infrastructure, but where bespoke radio signalling is in use, radio base stations can be used in a similar fashion and conventional train detection removed.

For non-ERTMS and non-radio based signalling areas, a driver carried GSM telephone carried for driver communication/emergency use, can be used, with the time differential block using the cell paging messages.

A train integrity function can be solved by fitting a GSM phone to the rear of the train, the two positions being used to determine the length of the train, with progression sequencing being used to prove train completeness.

The approach works equally well on metro (underground systems) providing a surface based GPS derived (or similar) reference can be supplied to each radio base station underground. The velocity factor of the transfer cabling would need to be either constant to each base station, or factored into the timing differences.

In rural/lower capacity areas, it is possible to move the automatic train protection (ATP) function to the trackside, as with time differential blocking, trackside infrastructure supervising train movement and commanding an emergency brake application over radio.

The present invention will now be described, by way of example, with reference to the accompanying drawing, in which:—

Figure 2:
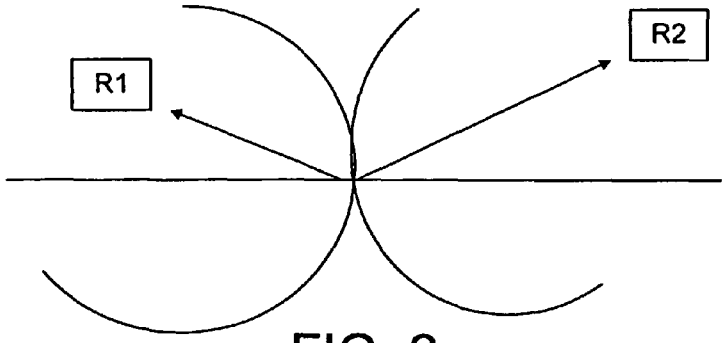

FIG. 1 is a block diagram of an embodiment of a system according to the present invention; and FIG. 2 is a diagram for use in explaining the operation of the embodiment.

In FIG. 1:—

Reference numerals 1F and 1R designate radio equipment in the cab at the front (F) of the leading vehicle and at the rear (R) of the last vehicle of a railway train 2;

Reference numeral 3 designates time of arrival (TOA) detection equipment;

Reference numeral 4 designates a time reference source;

Reference numeral 5 designates a block control device for assignment of a railway train into a signalling block;

Reference numeral 6 designates conventional signalling interlocking; and

Reference numeral 7 designates a signalling control system.

The railway train 2 is fitted with a set of radio equipment 1F in its leading cab, and where "end of train" detection is also required, the rear R of the last vehicle in the train consist is fitted with a set of radio equipment 1R. The radio equipment is typically GSM style, but can be any form of radio equipment that has a repeatable information burst facility to transmit from train to trackside.

The TOA detection equipment 3 is used to determine the time difference of a train transmitted signal at two reception sites (or more). The TOA equipment measures a reference point of the incoming radio message against a common system reference clock from source 4 which can be a national frequency standard or a GSM derived clock. The time difference is against the clock reference.

The TOA difference signals are compared against a reference table by the block control device 5, which holds a geographic map of the railway which is separated into segments. The TOA difference times of trains in the geographic area are determined beforehand by a reference or calibration train at commissioning, and therefore a new incoming time of arrival difference signal is compared to the reference table.

Mapping to the difference table allows a train location to be determined within a known geographical segment and therefore the position of the train within the conventional railway signalling "block" is known. Such "block" information is normally determined by track circuits or axle counter information in normal practice.

The TOA signal will also have a train identifier with it, assigning the TOA signal to a particular vehicle.

The block information is then transferred from the block control device 5 to the conventional signalling interlocking 6 to be used to interlock the railway in accordance with usual signalling practice.

The TOA detection equipment 3 could be based on the technology of systems available from TruePosition, Inc., of 780 Fifth Avenue, King of Prussia, Pa. 19406, USA. Such technology is described, for example, in U.S. Pat. Nos. 6,661,379; 6,646,604; 6,603,428; 6,563,460; 6,519,465; 6,492,944; 6,483,460; 6,463,290; 6,400,320; 6,388,618; 6,366,241; 6,351,235; 6,334,059; 6,317,604; 6,317,081; 6,285,321; 6,281,834; 6,266,013; and 6,172,644; US Patent Application Publication Nos. 2003/0016174 and 2003/0064734; WO 03/084079, WO 03/009613 and WO 03/009612; and GB-A-2 387 084.

Referring to FIG. 2, (Time of arrival of message at receiving site R1)−(Time of arrival of message at receiving site R2)=Locus of potential positions The locus of potential positions is constrained by the geographical railway, so therefore there is only one correct position where the train can exist, subject to an understanding of the railway layout being known by the system.

Using a single set of radio equipment 1F in the leading cab of the train 2, means that the length of the train must be assumed. Therefore, maximum lengths would normally be used to determine the rear of the train and the block control device 5 would add an offset to the location segment. This offset would be used by the interlocking 6 to determine the section of track occupied, i.e. the leading edge of the train segment to the segment plus offset as the rear of the train.

A further set of radio equipment 1R can be used at rear of the last vehicle of the train consist. Such equipment is used in the same way as that 1F in the leading cab, but this time the block control device 5 will compile the position of the front and the rear of the train against its segment map in the same manner as before. This time however, the maximum segments a train can straddle is limited—too many segments being occupied would indicate that a train has split and the rear of the train is no longer connected to the front, indicating there has been a train break. Conventionally this "end of train" function can be derived by a train wire running around the whole vehicle consist and a signal transferred around the loop—absence of the signal inferring there has been a train split. In many cases however, it is not possible to provide this circuit, and radio-based end of train detection is preferable.

Radio-based end of train detection also allows more precise indications of where the train position is, and thus the interlocking 6 will be able to work with more precision and can be used to improve capacity is some signalling layouts.

Using radio equipment 1R and 1F on the train allows for degradation conditions (such as multi-path effects in the TOA approach) to be mitigated.

The present invention is equally applicable to both moving block signalling systems (see for example U.S. Pat. Nos. 5,437,422; 5,947,423; and 5,366,183) and traditional fixed block signalling. In fixed block signalling, the information determined by the block control device 5 is cross-referenced from a geographical map to a segment, whereas in moving block signalling the position is a co-ordinate, which is used by a moving block controller.

Where the railway being signalled is a multiple track system (i.e. a number of tracks in parallel), the resolution of the system may be inadequate to determine which track the train is on. In this case, the train route will be used by the signalling control system 7 and the route information sequenced by the block control device 5. Each train movement across or along a set of tracks in a typical signalling scheme will have a prescribed route identifier and the block controller will sequence this with the TOA message.

In determining the location of a piece of radio transmitting equipment as described, the system would also have knowledge of the equipment's unique identifier, which is used in call set up and registration and subsequently used for tracking the vehicle locational changes as described. Using the principle of time differential blocking, the unique identifier can be used as a signalling "token". Tokens are used in railway signalling when train vehicles enter territories that do not have other means of train detection and therefore it is not possible to allow multiple trains to enter into an area for fear of possible collision. In such circumstances, a unique token (often a physical item) is given to the train vehicle on entering the section so controlled. If the token is not available, the train is not allowed to enter (i.e. there is a train already in the section holding the token). Thus, the use of a token with an associated procedure only allows one vehicle into a section at a time.

By using the principle of time differential blocking and coupled with a knowledge of the unique identity of the tracked transmitting equipment, a similar token system can be realised. In this application, the token (which may be electronic, or represented in software) can be assigned to the unique identity whilst the train passes through a token controlled area. As the train is known to leave the token area (through knowledge of the transmitting equipment's location), the token can be freed for use and passed to another vehicle. In this manner, it is possible, with minimal infrastructure, to create a traditional token block system with the time differential blocking equipment.

The invention claimed is:

1. A system for detection of the location of a railway vehicle, comprising means for using the time difference between reception at first and second points of a only one signal pulse initially sent from the vehicle to the first and second points at a single given time and a single location to produce an indication of that location of the vehicle through navigational triangulation, said first and second points being spaced from the vehicle and separate from each other.

2. A system according to claim 1, wherein said signal is sent from the front of the leading vehicle of a train of such vehicles and from the rear of the last vehicle in the train.

3. A system according to claim 2, arranged so that receipt of the signals is used for checking train completeness.

4. A system according to claim 1, wherein such a signal is unique to the identity of the railway vehicle.

5. A system according to claim 4, wherein the signal is used as a token in the system so that the system can act as a token block system.

6. A method of detecting a railway vehicle, comprising sending a only one initial pulse from the vehicle to a first point and a second point at a single time and location, determining the time difference between receiving at the first and second points the signal pulse and using that time difference to produce an indication of that location of the vehicle through navigational triangulation, said first and second points being spaced from the vehicle and separate from each other.

7. A method according to claim 6, wherein the signal is sent from the front of the vehicle.

8. A method according to claim 6, wherein the signal is sent from the rear of the vehicle.

9. A method according to claim 6, wherein the vehicle is the leading vehicle of a train of such vehicles, the signal being sent from the front of the leading vehicle, a further such signal being sent from the rear of the last vehicle in the train.

10. A method according to claim 9, wherein receipt of the signals is used for checking train completeness.

11. A method according to claim 9, wherein receipt of the signals is used for mitigating degradation conditions.

12. A method according to claim 6, wherein such a signal is unique to the identity of the railway vehicle.

13. A method according to claim 12, wherein the signal is used as a token for token block operation.

14. A system for detection of a railway vehicle, comprising means for using the time difference between reception at first and second points of only one signal pulse initially sent from the vehicle to the first and second points at a given time, and a reference clock wherein the time difference is measured against the reference clock, wherein said first and second points are spaced from the vehicle and separate from each other so that, through navigational triangulation an indication of the location of the vehicle results.

15. A system according to claim 14, arranged for using such a signal sent from the front of the leading vehicle of a train of such vehicles and such a signal sent from the rear of the last vehicle in the train.

16. A system according to claim 15, arranged so that receipt of the signals is used for checking train completeness.

17. A system according to claim 14, wherein such a signal is unique to the identity of the railway vehicle.

18. A system according to claim 17, wherein the signal is used as a token in the system so that the system can act as a token block system.

19. A method of detecting a railway vehicle, comprising using the time difference between receiving at first and second points a signal sent from the vehicle at a given time to produce an indication of the location of the vehicle, including the step of measuring the time difference against a reference clock.

20. A method according to claim 19, wherein the signal is sent from the front of the vehicle.

21. A method according to claim 19, wherein the signal is sent from the rear of the vehicle.

22. A method according to claim 19, wherein the vehicle is the leading vehicle of a train of such vehicles, the signal being sent from the front of the leading vehicle, a further such signal being sent from the rear of the last vehicle in the train.

23. A method according to claim 22, wherein receipt of the signals is used for checking train completeness.

24. A method according to claim 22, wherein receipt of the signals is used for mitigating degradation conditions.

25. A method according to claim 22, wherein such a signal is unique to the identity of the railway vehicle.

26. A method according to claim 25, wherein the signal is used as a token for token block operation.

* * * * *